United States Patent [19]

Anderson et al.

[11] Patent Number: 4,750,617

[45] Date of Patent: Jun. 14, 1988

[54] GOLF-CLUB CARRIER WITH ROTATABLE CLUB ORGANIZER THEREIN

[76] Inventors: Haynes F. Anderson, 1450 NE. 4th Ave.; Zane L. Emerson, 200 SW. 2nd St., both of Boca Raton, Fla. 33432

[21] Appl. No.: 94,007

[22] Filed: Sep. 8, 1987

[51] Int. Cl.[4] ..... A63B 55/00

[52] U.S. Cl. ..... 206/315.6; 206/315.2; 206/315.5; 206/315.8

[58] Field of Search ..... 206/315.1, 315.2, 315.3, 206/315.4, 315.5, 315.6, 315.7, 315.8

[56] References Cited

U.S. PATENT DOCUMENTS

| | | | |
|---|---|---|---|
| 2,091,298 | 8/1937 | Agnew | 206/315.6 X |
| 2,890,061 | 6/1959 | Watson | 206/315.6 X |
| 3,425,708 | 2/1969 | Sato | 206/315.6 X |
| 4,111,248 | 9/1978 | Leichhardt | 206/315.6 |
| 4,245,684 | 1/1981 | Street et al. | 206/315.6 X |
| 4,673,082 | 6/1987 | Hemme | 206/315.6 |
| 4,703,851 | 11/1987 | Stewert | 206/315.6 |
| 4,709,814 | 12/1987 | Antonious | 206/315.3 |

*Primary Examiner*—William Price
*Attorney, Agent, or Firm*—John H. Faro

[57] ABSTRACT

A golf-club carrier comprising a rigid cylindrical sleeve having a lower end and an upper end, a base plate mounted within the lower end of the sleeve, and a cylindrical golf-club holder rotatably mounted within the sleeve to the base plate. The holder includes a plurality of wheels mounted on the holder and adapted to provide rolling contact with the inner surface of the sleeve. Sideward forces are distributed among several of the wheels, which are free to roll on the cylindrical inner surface of the rigid sleeve. The holder functions as a club organizer and allows for a separate compartment to be used for each club and the organization of the clubs within the bag in any one of a number of arrangements.

18 Claims, 1 Drawing Sheet

Fig. 1.
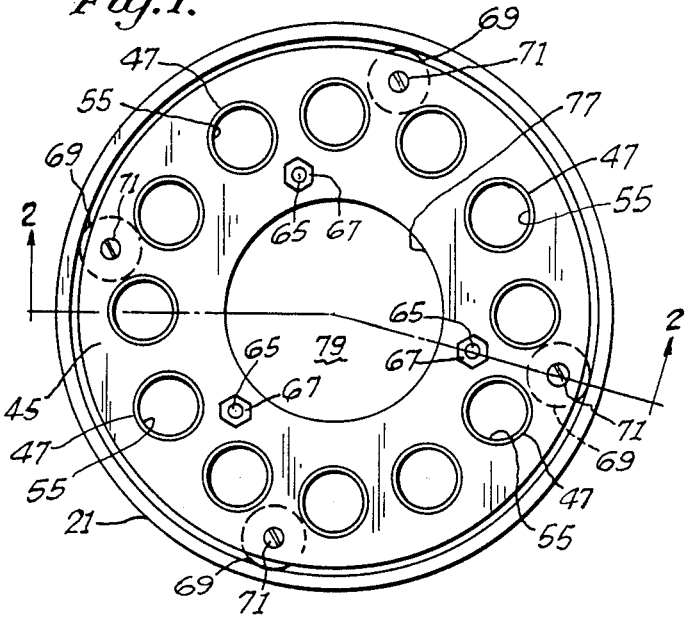
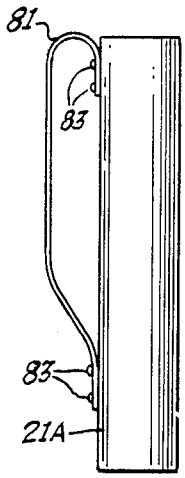
Fig. 3.
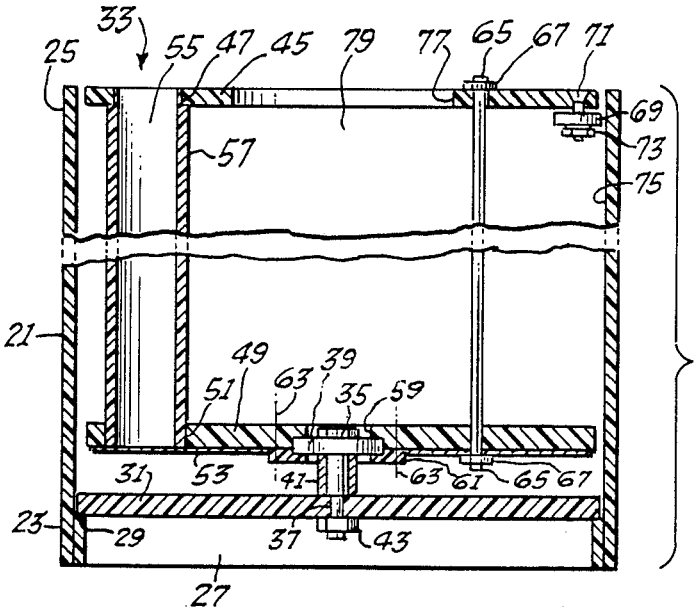
Fig. 2.

GOLF-CLUB CARRIER WITH ROTATABLE CLUB ORGANIZER THEREIN

BACKGROUND OF THE INVENTION

1. Field of the Invention

This invention relates to a novel golf-club carrier and particularly to a golf-club carrier comprising a rotatable club holder having a separate retaining compartment for each club shaft. The novel carrier may be inserted into a golf bag, or may be used alone when equipped with a shoulder strap or other manual carrying means.

2. Description of the Prior Art

Golfers transport a bag containing eight to sixteen golf clubs together with other items around the golf course on a shoulder strap, or on a pull cart, or on a motorized carrier. When the clubs are placed together in a golf bag, they rub against one another causing wear and damage to the clubs. Also, they can become randomly intermixed with one another so that a particular club may be difficult to find when it is needed.

To overcome the problems arising from intermixing, several expedients have been suggested for holding the golf clubs individually and in a particular order in cups, slots, notches or tubes; as described for example, by U.S. Pat. Nos. 1,758,902 to E. C. Boyce; 2,551,780 to D. B. Wood; 3,966,051 to R. O. Hollister; and 4,181,167 to L. J. Ret.

More recently, it has been suggested to transport golf clubs in a golf bag having a rotatable club holder which provides all of the foregoing advantages. In addition, this structure permits the golfer to rotate the holder to bring a particular position in the holder closer to the golfer so that a golf club can be inserted or removed. Golf bags with rotating holders are exemplified by U.S. Pat. Nos. 4,111,248 to H. A. Leichhardt and 4,673,082 to R. O. Hemme.

Prior rotatable golf-club holders usually have club retention means, such as slots, notches or bands, that contact the club shafts thereby requiring special efforts to insert and remove the clubs. Such physical contact rubs on the shafts. Also, prior rotatable golf-clubs holders have inadequate means for resisting sideward forces at the upper end of the bag. This is particularly aggravated when the golf bag is attached to, and rests on the shelf of, a motorized golf cart. In such case, the golf bag is located relatively high off the ground, and is frequently positioned at an angle from vertical, so that the holder experiences strong sideward forces from the cart when the cart is moving, and from the golfer when a club is inserted in or removed from the holder when the cart is stopped.

OBJECTS OF THE INVENTION

An object of this invention is to provide a novel golf-club carrier comprising a rotatable club holder.

A further object is to provide a novel golf-club carrier with improved means for rotating the club holder therein.

Another object is to provide a novel carrier comprising a golf-club holder in which the clubs are stored separately without physically contacting the sides of the club shafts.

Still another object is to provide a novel golf-club carrier that may be inserted into a golf bag or may be used as it is.

Yet another object is to provide a novel golf-club carrier that can be carried by a golfer, or be transported on a pull cart, or be transported on a motorized cart.

And another object is to provide a novel golf-club carrier that is particularly adapted for transport on the shelf of a motorized golf cart.

SUMMARY OF THE INVENTION

The above and related objects of this invention are achieved by providing a novel golf-club carrier comprising a rigid cylindrical sleeve having a lower end and an upper end, a base plate mounted within the lower end of the sleeve, and a cylindrical golf-club holder/organizer rotatively mounted within the sleeve to the base plate. The holder/organizer includes a plurality of wheels mounted on the holder and adapted to provide rolling contact with the inner surface of the sleeve within the upper end thereof. Thus, sideward forces are distributed among several upper wheels which are free to roll on the cylindrical inner surface of the rigid sleeve.

The novel structure functions as a club organizer and allows the use of tubes, instead of notches or slots, for retaining the clubs in a defined relationship without clamping the club shafts. Where the tubes are in a circular array in the holder, the volume within the array may be used for storage. The novel carrier may be inserted in common types of golf bags, or the carrier may be provided with a shoulder strap or other carrying means attached to the sleeve.

BRIEF DESCRIPTION OF THE DRAWINGS

FIG. 1 is a top view of a preferred embodiment of the novel carrier described herein.

FIG. 2 is a broken away side elevational view of the preferred embodiment shown in FIG. 1 viewed along section line 2-2.

FIG. 3 is a side elevational view of another embodiment of the invention having a shoulder strap attached thereto.

DETAILED DESCRIPTION OF THE INVENTION INCLUDING PREFERRED EMBODIMENTS

The following description of some of the preferred embodiments of the concepts of this invention is made in reference to the accompanying figures. Where an individual structural element is depicted in more than one figure, it is assigned a common reference numeral for simplification of identification and understanding.

Referring to FIGS. 1 and 2, the preferred embodiments of the novel carrier comprises a rigid cylindrical sleeve (21) having a lower end (23) and an upper end (25). The sleeve (21) may be of metal or plastic but, preferably, is a segment of pressed asbestos pipe. The sleeve (21) serves the dual function of providing the structural component of the bag and protecting both the organizer tubes (55) and golf club shafts from bending and wear. A ring (27) of the same or a different material is cemented or otherwise fastened to the inside surface at said lower end (23) providing a circular mounting shelf (29) (FIG. 2).

As shown in FIG. 2, a circular base plate (31) is mounted inside the lower end (23) on the shelf (29). A club holder (33) is mounted inside the sleeve (21) on the base plate (31) with a bolt (35), through a central aperture (37) in base plate (31). The bolt (35) passes through a thrust-type bearing (39) in the holder (33) and a spacer (41), and is held in place by a nut (43).

The holder (33) includes an upper end plate (45) having a plurality of upper apertures (47) therein arranged in a circular array, and a lower end plate (49) having a corresponding and opposite plurality of lower apertures (51) therein. A circular metal backup plate (53) is positioned adjacent and under the lower end plate (45). A tube (55) is positioned in each combination of an upper aperture (47) and a corresponding lower aperture (51). The lower end of each tube (55) abuts on the backup plate (53). The upper end of each tube (55) is recessed providing a shoulder (57) which abuts on the upper end plate (45). The base plate (31) and the end plates (45) and (49) are each made from half-inch-thick sheets of acrylic plastic. A center plate (not shown) between the end plates (45) and (49) may be included to provide increased structural stability.

The thrust-type bearing (39), which is preferably a ball-type bearing, is mounted in a recessed central aperture (59) in the lower end plate (49), and is held in place by a retainer ring (61) which is attached to the lower end plate (49) with screws (63). The club holder (33) is held together by three tension rods (65), which pass through the upper end plate (45), the lower endplate (49) and the backup plate (53) and are tensioned with tensioning nuts (67). The rods (65) provide structural stability and prevent any twisting action of the tubes (55).

Four rotatable wheels (69), which are preferably ball-type bearings, are mounted on the underside of the upper end plate (45) with countersink screws (71) and nuts (73). The wheels (69) extend slightly beyond the periphery of the upper end plate (45) and are positioned to provide rolling contact with the inner surface (75) of the sleeve (21) within the upper end (25) thereof, particularly when there is a side force between the holder (33) and the sleeve (21). The upper end plate (45) also has a large central opening (77) therein permitting access to the chamber (79) defined by the tubes (55) and the end plates (45) and (49). This chamber (79) may be used for the storage of miscellaneous articles such as an umbrella and/or a towel.

All of the parts of the novel carrier may be made out of materials that are commonly used for similar purposes, and different parts may be made of different materials. Since golf-club carriers are sometimes exposed to rain and damp conditions, and frequently are stored under humid conditions, it is preferred to use materials that do not corrode or deteriorate (or at least do so very slowly) in the presence of moisture. To this end, plastics and corrosion-resistant alloys are favored. Where plastics are used the materials should be resistant to deterioration from sunlight. Some other corrosion resistant materials that can be used are stainless steel, aluminum and fiberglass. In order to prevent the build up of moisture within each tube (55), a drainage hole (not shown) is provided where the tube is attached to the lower endplate (49).

The thrust bearing (39) in the lower end plate (49) and the wheel bearings (69) in the upper end plate (45) should be of sufficient size and strength to handle the weight and forces they will be called upon to handle. Also, these bearings should be shielded from the dust and dirt that is invariably present on the golf course. While specific mountings for these bearings are shown, other mountings may be used as is known in the art. The thrust bearing (39) transmits substantially all of the weight of the holder (33) and its contents to a load bearing base plate (31) and, to a limited extent, must also resist sideward forces therebetween. The upper wheels (69) provide most of the resistance to sideward forces and also provide most of the ease of rotatability to the holder (33). This can best be achieved by providing a plurality of wheels evenly distributed around the upper end plate (45).

Each tube (55) is designed to retain the shank or handle of a golf club with the head up and out of the club holder. To accommodate most golfers, there are 10 to 16 tubes (55) to hold an equal number of clubs. The tubes (55) are about 1.5 inches (3.81 cm) inside diameter and their lengths are slightly less than the length of the shank on the shortest club, or about 32 inches (81.28 cm). With this length of tube, the end of each club handle rests on the backup plate (53) with essentially no contact between the inside of the tubes (55) and the club handles held therein. Alternating, each tube may be dedicated for a particular club. By having a plug of the appropriate length at the bottoms of the appropriate tubes, the club heads can be held at a common level above the holder with the ends of the shafts on the plugs. The tubes (55) may be evenly or unevenly distributed around the holder (33).

The entire carrier can be slid into a golf bag of common design and carried or transported in any prior known mode. The sleeve may be of a decorative material. Also, as shown in FIG. 3, the novel carrier may be provided with a means for manually carrying the unit such as a shoulder strap (81) attached to the sleeve (21A) as with rivets (83). The novel carrier is preferably constructed of the lightest sturdiest materials available, and all screws, rods and nuts may be recessed and plugged to prevent corrosion and to cover exposed sharp edges.

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. A golf-club carrier comprising a rigid cylindrical sleeve having a lower end and an upper end, a base plate mounted within the lower end of said sleeve, and a cylindrical golf-club holder rotatably mounted within said sleeve to said base plate, said holder including a plurality of rotatable wheels mounted on said holder and adapted to provide rolling contact with the inner surface of said sleeve within the upper end thereof.

2. The carrier defined in claim 1 wherein the mounting for said holder to said base includes a thrust-type bearing adapted to resist both longitudinal and transverse forces therebetween.

3. The carrier defined in claim 2 wherein said wheels and said thrust-type bearing are ball-bearings.

4. The carrier defined in claim 1 wherein said holder includes a plurality of tubes, each tube being adapted to hold the shaft of one golf club with the club-head thereof extending beyond the upper end of said sleeve.

5. The carrier defined in claim 4 wherein said tubes have substantially equal lengths and are adapted to hold the golf club with the shortest shaft length.

6. The carrier defined in claim 4 wherein said tubes are arranged in a circular array in said holder.

7. The carrier defined in claim 4 including means for manually carrying said carrier attached to said sleeve.

8. The carrier defined in claim 7 including a shoulder strap attached to said sleeve.

9. The carrier defined in claim 4 wherein said carrier is adapted to be inserted into a golf bag.

10. The carrier defined in claim 6 including means for accessing the space defined by said circular array of tubes.

11. A golf-club carrier comprising a rigid cylindrical sleeve having a lower end and an upper end, a base plate mounted within the lower end of said sleeve, and a cylindrical golf-club holder rotatably mounted within said sleeve to said base plate, said holder including a lower end plate, an upper end plate and a plurality of tubes held therebetween by said end plates, said upper end plate having a separate aperture therein opening into each of said tubes, each tube and associated aperture being adapted to receive and to hold the shaft of a golf club, said holder having a thrust bearing centrally mounted on said lower end plate, said thrust bearing being connected to said base plate, and said holder having a plurality of rotatable wheels mounted along the periphery of said upper end plate and adapted to provide rolling contact with the inner surface of said sleeve within the upper end thereof when there is a transverse force between said holder and the upper end of said sleeve.

12. The carrier defined in claim 11 wherein said thrust bearing is a ball bearing and each of said wheels is a ball bearing.

13. The carrier defined in claim 11 wherein said tubes are arranged in a circular array concentric with said cylindrical holder.

14. The carrier defined in claim 11 wherein the upper ends of said tubes are recessed and are seated in said openings in said upper end plate.

15. The carrier defined in claim 11 including tensioning means for drawing together said end pieces.

16. The carrier defined in claim 11 including a circular shelf on the inside surface of said sleeve within the lower end thereof, and said lower end plate abuts said shelf.

17. The carrier defined in claim 11 wherein said holder is adapted in size and shape to slide into and be contained by a substantially cylindrical golf bag.

18. The carrier defined in claim 11 including carrying means attached to said sleeve.

* * * * *